US005197250A

United States Patent [19]

Kramer

[11] Patent Number: 5,197,250

[45] Date of Patent: Mar. 30, 1993

[54] WIDE EXPANSION JOINT SYSTEM

[75] Inventor: Fred Kramer, Hales Corners, Wis.

[73] Assignee: Tremco Incorporated, Cleveland, Ohio

[21] Appl. No.: 881,901

[22] Filed: May 12, 1992

[51] Int. Cl.[5] ..... E01C 11/10

[52] U.S. Cl. ..... 52/396; 404/65; 404/67; 404/69

[58] Field of Search ..... 52/396, 403; 404/47, 404/56, 57, 58, 64, 65, 66, 67, 68, 69

[56] References Cited

U.S. PATENT DOCUMENTS

| | | | |
|---|---|---|---|
| 3,165,987 | 1/1965 | Hirst et al. | 404/47 |
| 3,722,379 | 3/1973 | Koester . | |
| 3,797,188 | 5/1974 | Mansfeld . | |
| 4,279,533 | 6/1981 | Peterson et al. . | |
| 4,285,612 | 8/1981 | Betti | 52/396 X |
| 4,346,542 | 8/1982 | Tateno . | |
| 4,533,278 | 8/1985 | Corsover et al. . | |
| 4,601,604 | 6/1986 | Clark et al. . | |
| 4,784,516 | 11/1988 | Cox . | |

OTHER PUBLICATIONS

Catalog No. GI-0989-016G Harry S. Peterson Co.
Konflex TM200 Brochure Emseal Joint Systems Ltd.
Brochure 05800/EMS Emseal Joint Systems Ltd.
Elastolock Brochure MM Systems Corp. (1990).
Brochure 05800/WAS Watson Bowman Acme Inc.
Brochure 05800/EPN E'Epoxy Industries Inc. (1989).

*Primary Examiner*—David A. Scherbel
*Assistant Examiner*—Robert J. Caufield
*Attorney, Agent, or Firm*—Ralph E. Jocke; David P. Dureska

[57] ABSTRACT

An expansion joint sytem (10) spans a slot (12) of adjacent concrete slabs (14, 16). The system includes a boxed out area (22) adjacent the slot. A plate member (32) extends across the slot. A preformed resilient pad (42) is positioned above the plate member. Nosings (64) of resilient material are bonded to the pad and to the surfaces bounding the boxed out area. The pad has a cross sectional configuration that achieves enhanced bonding to the nosings, greater flexibility and resistance to failure in cold weather, and greater elongation without failure.

9 Claims, 2 Drawing Sheets

WIDE EXPANSION JOINT SYSTEM

TECHNICAL FIELD

This invention relates to expansion joint systems which extend between two relatively movable, rigid slabs such as sections of a roadway, bridge, parking deck or plaza deck. Specifically, this invention relates to an expansion joint system that has greater resistance to failure due to excessive elongation and which provides greater reliability, particularly in cold temperatures.

BACKGROUND ART

Expansion joint systems of various types are well known in the prior art. Expansion joint systems are used to bridge a slot that extends between adjacent slabs of concrete or other rigid materials which make up the traffic surfaces of a roadway, bridge, parking deck or plaza deck. The slabs are relatively movable to one another due to factors such as loading, thermal expansion and contraction, and settling. The slot enables the slabs to move relative to one another without damaging the structural integrity of either slab.

Expansion joint systems are used to bridge the slot between the adjacent slabs, and to maintain the continuity of the traffic surface in the area over the slot. Expansion joint systems must function despite cyclical increases and decreases in the width of the slot, and changes in vertical elevations of the slabs. The expansion joint must also prevent contaminants such as water, road salt and dirt from infiltrating the slot. The infiltration of such contaminants may result in damage to the slabs or to the supporting structure underlying the slabs.

A well known prior art expansion joint system has included a vertically recessed boxed out area in the slabs adjacent the slot. A plate member is positioned in the boxed out area and spans the slot. A pad of resilient material is positioned above the plate member. The pad typically has an upper surface that is at the level of the traffic surfaces of the adjacent slabs. The pad is usually rectangular in cross section, and is either preformed or molded in place depending on the type of joint system.

Nosings typically extend on either side of the pad. The nosings are formed in place and are comprised of a resilient material that is somewhat harder than the pad. The nosings serve to bond the pad to the walls of the slabs in the boxed out area. The nosings are also typically filled to the vertical height of the traffic surfaces of the slabs.

As the slabs move relative to one another, the plate member of the expansion joint system slides on the horizontal surfaces of the slabs in the boxed out area. The resilient pad and nosings expand and contract as the slabs move relative to one another.

It is not uncommon for adjacent slabs to move apart more than anticipated by the designer of the structure. In such circumstances the pad will usually separate from one of the nosings along a vertical side wall of the rectangular slab. When this occurs the integrity of the joint system is lost. Water and other contaminants infiltrate the slot and may cause damage. In cold climates, water which has infiltrated the slot will undergo freeze and thaw cycles which is particularly damaging to the adjacent slabs.

Unfortunately, failures of expansion joint systems are particularly common in cold conditions. This is because the pad and the nosings often become very brittle as temperature decreases. Impacts on the expansion joint due to heavy traffic or movement of the slabs due to loading or contraction, may cause the nosings and the pad to separate.

Problems may also arise when the expansion joint system must be installed in cold weather. In such conditions the materials commonly used to form the nosings cannot cure as well as in warmer weather. This may result in a poor bond between the pad and the nosings which causes premature separation at a bond line between the pad and the nosings.

Thus, there exists a need for an expansion joint system that achieves greater elongation and greater failure resistance, particularly in cold temperatures.

DISCLOSURE OF INVENTION

It is an object of the present invention to provide an expansion joint system that is reliable and that has greater resistance to failure.

It is a further object of the present invention to provide an expansion joint system that achieves greater elongation without damage to system integrity.

It is a further object of the present invention to provide an expansion joint system that has greater failure resistance in cold temperatures.

It is a further object of the present invention to provide an expansion joint system that is more resistant to failure when installed in cold weather.

Further objects of the present invention will be made apparent in the following Best Modes for Carrying Out Invention and the appended claims.

The foregoing objects are accomplished in the preferred embodiment of the present invention by an expansion joint system which extends across a slot between adjacent concrete slabs. The slabs include a vertically recessed boxed out area adjacent the slot. The boxed out area is bounded by horizontally extending surfaces adjacent the slot on each slab, and upward extending surfaces which extend between the horizontal surfaces and the upper traffic bearing surfaces of the slabs.

The expansion joint system further includes a plate member which spans the slot and is supported on the horizontally extending surfaces of the boxed out area. In the preferred form of the invention, the plate member is of the type that is self centering in the slot, such as that shown in U.S. Pat. No. 4,533,278.

A preformed pad comprised of resilient rubber material is positioned vertically above the plate member. In cross section, the pad has a central portion and end portions. The central portion is bounded by an upper wall which is generally at the level of the traffic surfaces of the slabs. The central portion is further bounded by an intermediate wall vertically below the upper wall and in supporting contact with the upper surface of the plate member.

Each end portion is bounded in cross section by a downward and outward extending side wall, which extends at an obtuse angle relative to the upper wall of the central portion. In the preferred form of the invention, the angle of the side wall is 135 degrees to the upper wall. The side walls terminate at lower points that are adjacent and in supporting contact with the horizontally extending surfaces of the boxed out area. The end portions are further bounded in cross section by bottom walls which extend inward towards the slot from the lower points. The bottom walls are also in supporting contact with the horizontally extending surfaces of the boxed out area.

The end portions of the pad are further bounded in cross section by upward extending inside walls. The inside walls are adjacent, but disposed from, outward ends of the plate member. The pad is further bounded in cross section by rounded surfaces which extend between the upward extending inside walls and the intermediate wall of the central portion.

The expansion joint system further includes nosings which extend on both sides of the pad. The nosings are formed in place and are comprised of a resilient material that is relatively harder than the pad. The nosings are bonded to the side walls of the pad and the surfaces of the slab which bound the boxed out area. The nosings have top surfaces, which in cross section are generally at the same level of the traffic surfaces of the slabs.

The expansion joint system of the present invention enables the slabs to move further apart than prior art joints without compromising the integrity of the expansion joint system. The joint system also has increased resistance to failure compared to other expansion joint systems when used or installed in cold temperatures.

BEST MODES FOR CARRYING OUT INVENTION

Figure 1:
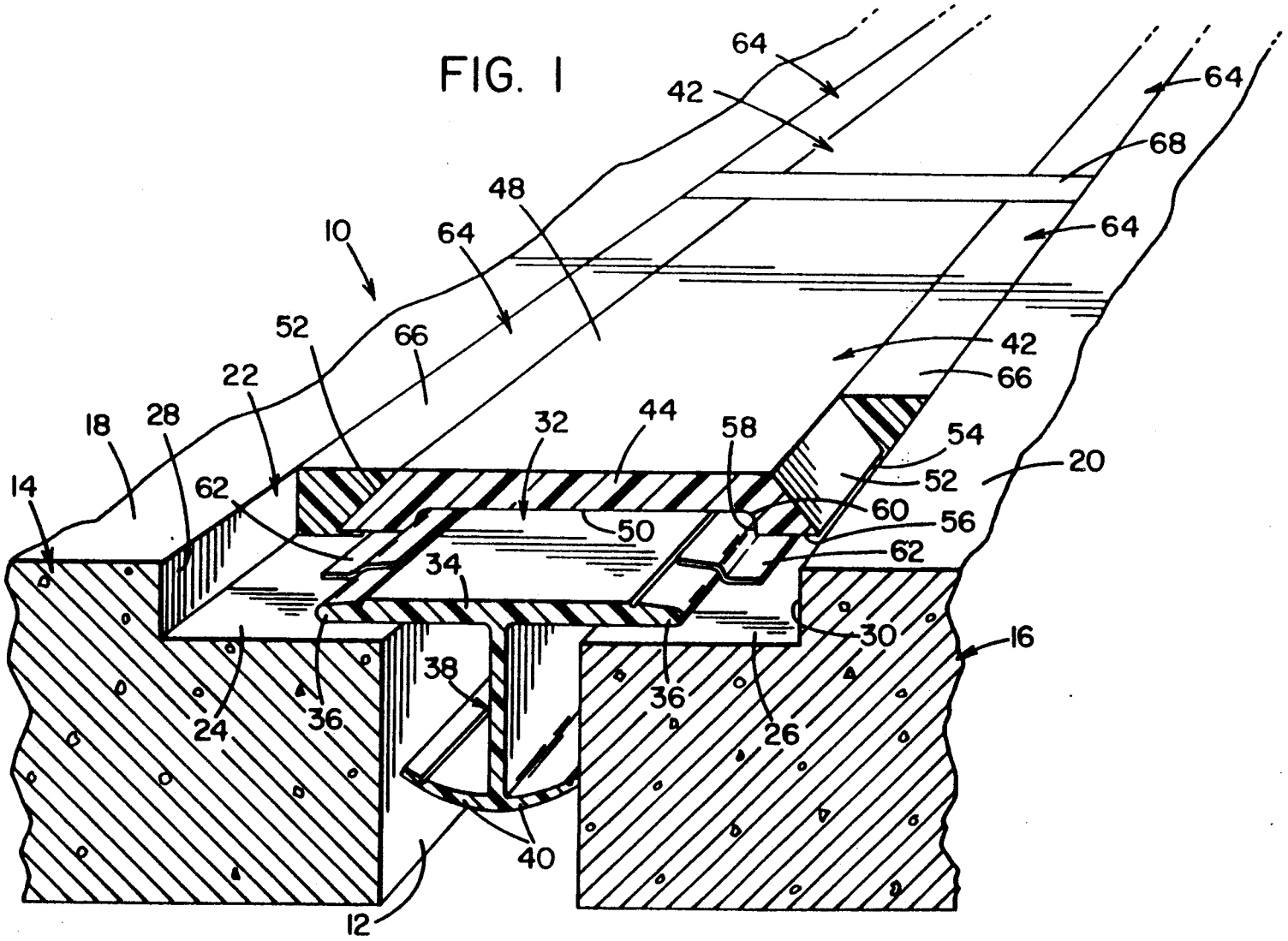
FIG. 1 is an isometric layered, cutaway view of the expansion joint system of the preferred embodiment of the present invention.

Referring now to the drawings and particularly to FIG. 1, there is shown therein the preferred embodiment of the expansion joint system of the present invention, generally indicated 10. The system extends across a slot 12 between a first concrete slab 14 and a second concrete slab 16. Slabs 14 and 16 include upper surfaces 18 and 20 respectively, which carry pedestrian or vehicular traffic.

A boxed out area 22 is recessed in the slabs adjacent the slot. The boxed out area is bounded by horizontally extending surfaces 24 and 26, and upward extending surfaces 28 and 30, on the first and second slabs respectively. In the preferred form of the invention, the upward extending surfaces 28 and 30 extend vertically to the level of the upper surfaces of the slabs.

A plate member 32 extends across slot 12. Plate member 32 is of the type shown in U.S. Pat. No. 4,533,278, which is owned by the assignee of the present invention and the disclosure of which is incorporated herein by reference. Plate member 32 has a flat upper portion 34 (see FIG. 2) which overlies the horizontally extending surfaces 24 and 26 of the slabs. Flat portion 34 terminates in rounded outward ends 36. Upper portion 34 of the plate member is supported on each of the horizontally extending surfaces of the slabs and is relatively movable thereon.

Plate member 32 further includes a downward extending arrow shaped portion 38. Arrow shaped portion 38 includes wings 40 which serve to center the plate member with respect to the slot 12. In the preferred form of the invention, plate member 32 is comprised of a plastic material and is of unitary construction.

While the preferred embodiment the plate member is of the type which includes a self centering feature, in other embodiments simple flat plate members may be used. The present invention is equally applicable to plate members of all types that are supported by and movable on horizontally extending surfaces in a boxed out area adjacent a slot.

Figure 2:
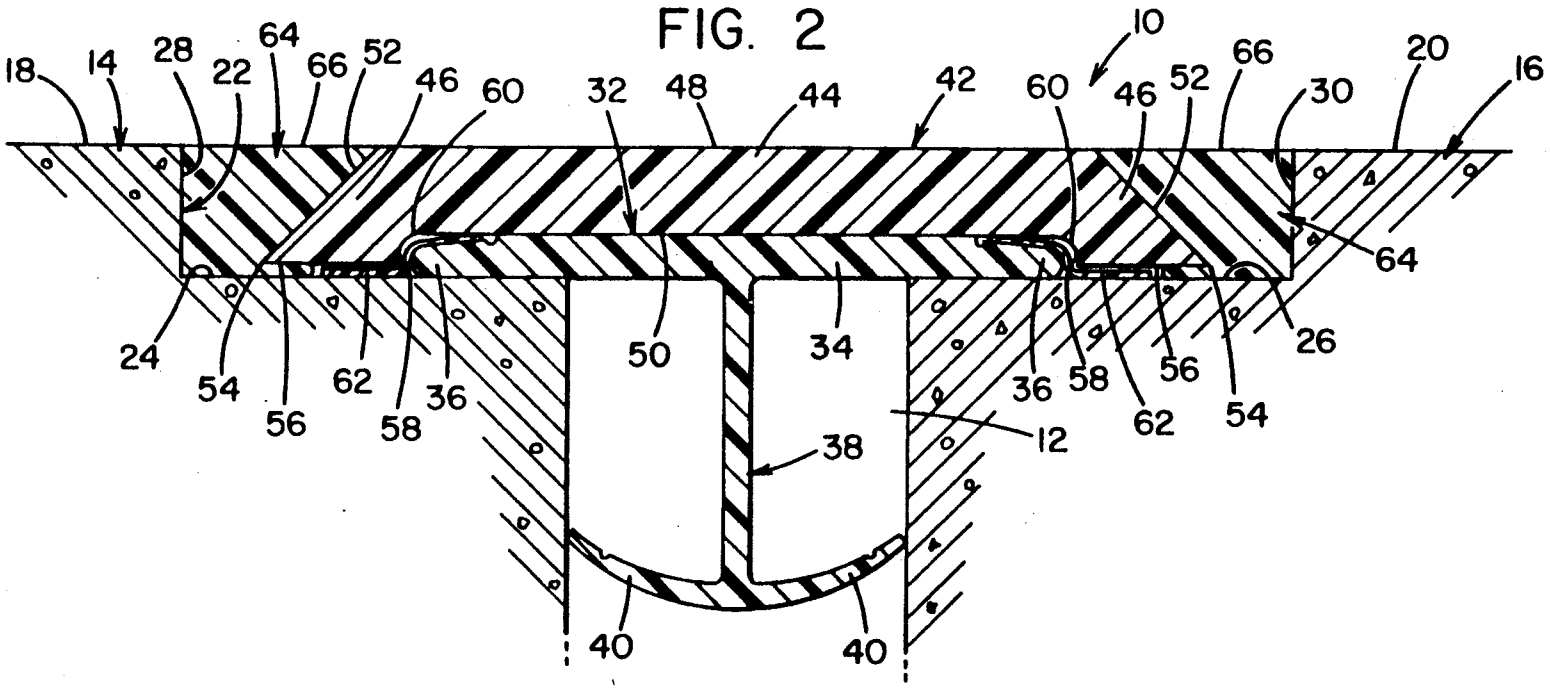
FIG. 2 is a cross sectional view of the expansion joint system shown in FIG. 1.
Figure 3:
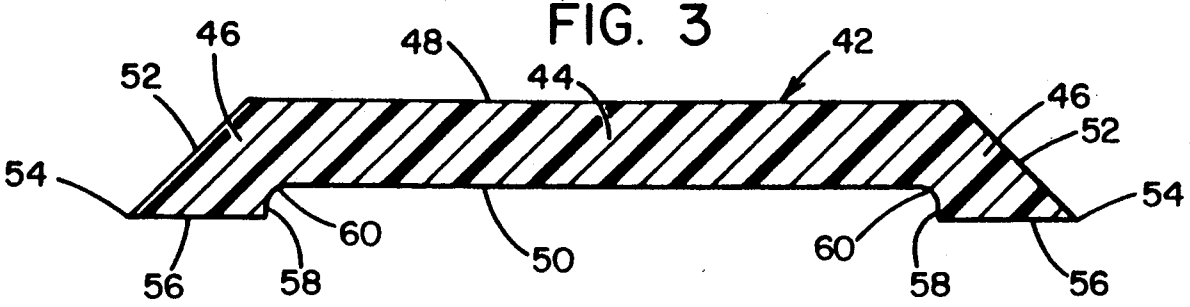
FIG. 3 is a cross sectional view of the resilient pad of the expansion joint system.

A preformed pad 42 of resilient material overlies the flat upper portion 34 of plate member 32. As best shown in FIGS. 2 and 3, pad 42 includes a central portion 44 and end portions 46. Central portion 44 is bounded in cross section by an upper wall 48 which extends horizontally and is generally at the level of the upper surfaces 18 and 20 of the slabs. Central portion 44 is further bounded by an intermediate wall 50, which is disposed vertically below the upper wall and is supported on the flat upper portion 34 of plate member 32.

End portions 46 are bounded in cross section by downward depending side walls 52. Side walls 52 extend downwardly and outwardly at an obtuse angle relative of the upper wall 48 of the central portion. Preferably the side walls extend at angles in a range from 120 to 135 degrees relative of the upper wall.

Side walls 52 terminate adjacent the horizontally extending surfaces of the boxed out area at lower points 54. End portions 46 are further bounded in cross section by bottom end walls 56 which extend inward towards the slot from the lower points 54.

End portions 46 are further bounded in cross section by upward extending inside walls 58. Inside walls 58 are adjacent but outwardly disposed from, the outward ends 36 of plate member 32. As a result, the upper portion 34 of plate member 32 is nested between the inside walls of the pad. The pad is further bounded in cross section by rounded surfaces 60 which extend between inside walls 58 and the intermediate wall 50 of the central portion.

Bond breaker tape members 62 are positioned between the outward ends 36 of the plate member 32 and the inside walls 58 of the pad. The bond breaker tape members 62 are very thin and have adhesive lower surfaces that hold the tape members to the adjacent horizontally extending surfaces of the slab and the plate member. The tape members 62 have top surfaces that are of a non-stick character.

The tape members facilitate relative movement of the pad with respect to the plate member by reducing friction. However, other embodiments of the invention which do not include the tape members operate in a satisfactory manner.

Nosings 64 in cross section are positioned on the outboard sides of pad 42. The nosings are comprised of resilient material and are poured and cured in place. The nosings are of a resilient material that are generally somewhat harder than the resilient material which comprises the pad. The nosings 64 have top surfaces 66 that are generally at the level of the upper surfaces 18 and 20 of the slabs.

Because the nosings 64 are poured and cured in place, they are chemically and mechanically bounded to the side walls 52 of the pad. The nosings 64 are further bonded to the horizontally extending surfaces 24 and 26, and the upward extending surfaces 28 and 30, of the boxed out area 22.

In the preferred form of the joint system of the present invention, the resilient pad 42 is formed of a material known as THC 900 which is manufactured by the Tremco Company. The pad material is flexible at temperatures in the range of minus 60 degrees Fahrenheit. The nosings 64 are formed of a relatively hard durable multi-part elastomer system called HPL Sealant, which is also available from the Tremco Company. Of course, in other embodiments other materials suitable for the type of system involved may be used.

When joint systems are installed between slabs having substantial width there is often a need for lateral splice joints 68. The splice joints include tape members that extend both laterally and traversely between adjacent plate members. Pads of resilient material are formed and cured in place at an interface between adjacent plate members. The splice joints enable some lateral movement of the plate members and help avoid buckling. In the preferred form of the invention, the splice joints 68 are formed from a material called THC 901 which is available from the Tremco Company.

The slot 12 between the slabs in a typical application is generally in the range of from one to four inches across prior to any movement of the slabs. The boxed out area is typically 8 to 12 inches across and three-quarters to seven-eighths of an inch deep. The nosings are configured to be at least one-half inch wide at the bottom where they are in supporting contact, and bond to, the horizontally extending surfaces of the boxed out area. In other embodiments other dimensional relationships may be employed depending on the requirements of the joint system.

The expansion joint system is installed by first cleaning the concrete surfaces of the boxed out area 22 with a solvent such as Xylol or Toluol. The plate member 32 is then installed with the arrow shaped portion 38 extending into slot 12. The bond breaker tape members 62 are then installed over the outward ends 36 of the plate, if desired.

The pad 42 is cleaned with the solvent and placed above the plate member 32 so that the outward ends 36 of the plate member nested between the inside walls 58 of the pad.

The surfaces of the boxed out area are coated with a suitable primer material such as Deckline Primer, available from the Tremco Company. The side walls 52 of the pad are also coated with primer. The primer is allowed to dry to a tacky consistency. The nosings 64 are then poured in place and allowed to cure. The preferred composition for the HPL nosings is comprised of a mixture of 100 parts HPL base, 8 parts HPL curative, 0.59 parts HPL catalyst and 5 parts limestone colorpack which serves to add color. This nosing material forms a strong bond to the slabs and to the pad even in cool temperatures. To achieve faster curing of the nosings in cooler temperatures, additional catalyst may be added to the mixture.

If the slabs move away from each other due to loading or settling, the slot 12 will expand in width. In these circumstances, the nosings which are attached to the slabs will place the pad in tension. The central portion of the pad elongates to accommodate the additional width without rupture. The angled side walls 52 of the end portions of the pad provide a wide area for bonding of the nosings to the pad. This results in stresses at the bond line between the nosings and the side walls of the pad, that are less per square inch than a pad with a rectangular cross section of similar size would experience. Further, the rounded surfaces which extend between the end portions and central portion of the pad, serve to avoid stress concentrations which would otherwise cause rupture or tearing when the pad is severely elongated. As a result, the joint system of the present invention is able to achieve elongation 60% to 75% greater without failure than the standard systems that employ rectangular pads or pads with bevelled ends.

Further, such elongation is achieved with less stress than in prior art systems.

The expansion joint system of the present invention is also more resistant to failure at low temperatures. Pad 42 remains flexible at temperatures as low as minus 60 degrees Fahrenheit. The relatively thin cross section of the central portion compared to the end portions provides greater flexibility. As a result, movement of the slabs relative to one another and impacts, even in cold temperatures, will typically not damage the expansion joint system.

Thus, the new expansion joint system of the present invention achieves the above stated objectives, eliminates difficulties encountered in the use of prior devices and systems, solves problems and attains the desirable results described herein.

In the foregoing description certain terms have been used for brevity, clarity and understanding. However, no unnecessary limitations are to be implied therefrom because such terms are for descriptive purposes and are intended to be broadly construed. Moreover, the descriptions and illustrations are by way of examples and the invention is not limited to the exact details shown and described.

Having described the features, discoveries and principles of the invention, the manner in which it is constructed and operated, and the advantages and useful results obtained, the new and useful structures, devices, elements, arrangements, parts, combinations, systems, equipment, operations and relationships are set forth in the appended claims.

I claim:

1. An expansion joint system for a slot extending between adjacent slabs of relatively rigid material, said slabs including a boxed out area adjacent the slot, said boxed out area bounded by generally horizontally extending surfaces adjacent the slot and upward extending surfaces disposed from the slot, said slabs each having traffic bearing upper surfaces generally at the same vertical level, said expansion joint system comprising:

a plate member extending across the slot and supported on the horizontally extending surfaces;

a preformed pad of resilient material, said pad of sufficient width to traverse said plate member, said pad including in cross section:

a central portion bounded by an upper wall generally at the vertical level of the upper surfaces of the slabs, and an intermediate wall vertically below the upper wall; and end portions at opposed ends of said central portion, said end portions bounded by depending side walls extending downward and outward at an obtuse angle relative of said upper wall, said side walls terminating at lower points, and bottom end walls extending toward said slot from said lower points, said bottom end walls vertically below said intermediate wall and generally parallel and at the vertical level of the horizontally extending surfaces of the slabs; and nosings comprised of resilient material positioned between the side walls of the pad and the upward extending surfaces of the boxed out area, said nosings bonded to the side walls of the pad and the horizontally extending surfaces and the upward extending surfaces of the boxed out area, the nosings having a top surface substantially at the level of the upper surfaces of the slabs.

2. The expansion joint system according to claim 1 wherein the end portions of the pad are bounded by upward extending inside walls extending from said bottom end walls, and said pad is further bounded in cross section by rounded surfaces extending between said inside walls and said intermediate wall of said central portion.

3. The expansion joint system according to claim 2 wherein said plate member includes a flat upper portion disposed between said inside walls.

4. The expansion joint system according to claim 3 wherein and said intermediate wall of said pad is supported on said flat portion of said plate member.

5. The expansion joint system according to claim 4 wherein the obtuse angle of the depending side walls of said pad relative to the upper wall is in a range generally from 120 degrees to 135 degrees.

6. The expansion joint system according to claim 5 wherein the nosings are of a resilient material relatively harder than the pad.

7. The expansion joint system according to claim 6 wherein the plate member further comprises a centrally positioned downward depending arrow shaped portion of plastic material, said arrow shaped portion extending into the slot, whereby the plate member is centered relative to the slot.

8. The expansion joint system according to claim 7 wherein the flat portion of the plate member includes outward ends adjacent the inside walls of the pad, and said system further comprises at least one tape member disposed intermediate of at least one of said outward ends and an adjacent inside wall of the pad, said tape member having a non-stick top surface and an adhesive bottom surface, said bottom surface engaging said plate member and a horizontally extending surface of the boxed out area.

9. The expansion joint system according to claim 8 wherein the system comprises two tape members, and wherein a tape member extends over each of said outward ends of said plate member and a horizontally extending surface adjacent thereto.

* * * * *